US007748743B2

(12) United States Patent
Knaup

(10) Patent No.: US 7,748,743 B2
(45) Date of Patent: Jul. 6, 2010

(54) STRUCTURAL OR CHASSIS COMPONENT FOR A MOTOR VEHICLE, AND METHOD OF MAKING SUCH A STRUCTURAL OR CHASSIS COMPONENT

(75) Inventor: Hans-Jürgen Knaup, Bad Lippspringe (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 607 days.

(21) Appl. No.: 11/671,648

(22) Filed: Feb. 6, 2007

(65) Prior Publication Data

US 2007/0180697 A1 Aug. 9, 2007

(30) Foreign Application Priority Data

Feb. 8, 2006 (DE) ..... 10 2006 005 964

(51) Int. Cl.
*B62D 21/00* (2006.01)

(52) U.S. Cl. ..... 280/800; 29/897.2

(58) Field of Classification Search ..... 280/800; 29/897.2; 72/379.2; 296/203.01
See application file for complete search history.

(56) References Cited

U.S. PATENT DOCUMENTS 5,577,796 A * 11/1996 Clausen ..... 296/202
5,937,691 A * 8/1999 Kanemitsu et al. ..... 72/355.4
6,082,166 A * 7/2000 Marin ..... 72/348
6,227,609 B1 * 5/2001 Mellis ..... 296/146.6
6,276,185 B1 * 8/2001 Owens ..... 72/350
6,293,134 B1 * 9/2001 Johnson ..... 72/335

FOREIGN PATENT DOCUMENTS

| | | |
|---|---|---|
| DE | 33 43 709 A1 | 6/1984 |
| DE | 196 42 995 C | 1/1998 |
| DE | 198 01 341 A1 | 7/1998 |
| EP | 0 919 304 A | 6/1999 |
| JP | 08128487 | 5/1996 |
| WO | WO 91/00155 | 1/1991 |
| WO | WO 99/07492 | 2/1999 |

* cited by examiner

*Primary Examiner*—Paul N. Dickson
*Assistant Examiner*—Timothy Wilhelm
(74) *Attorney, Agent, or Firm*—Henry M. Feiereisen; Ursula B. Day

(57) ABSTRACT

In a method of making a structural or chassis component for a motor vehicle, a blank is provided with at least one material supply in an outer region at a distance to the outer edge to serve as material reserve. The blank is placed in a press tool for shaping the blank into a structural or chassis component by displacing the material supply in a direction of the outer edge and pressing the outer region of the blank against a buttress of the press tool to thereby form the outer region in a recess of the press tool to produce bead.

11 Claims, 2 Drawing Sheets

STRUCTURAL OR CHASSIS COMPONENT FOR A MOTOR VEHICLE, AND METHOD OF MAKING SUCH A STRUCTURAL OR CHASSIS COMPONENT

CROSS-REFERENCES TO RELATED APPLICATIONS

This application claims the priority of German Patent Application, Serial No. 10 2006 005 964.6, filed Feb. 8, 2006, pursuant to 35 U.S.C. 119(a)-(d), the content of which is incorporated herein by reference in its entirety as if fully set forth herein.

BACKGROUND OF THE INVENTION

The present invention relates, in general, to a structural or chassis component for a motor vehicle, and a method of making such a structural or chassis component.

Nothing in the following discussion of the state of the art is to be construed as an admission of prior art.

Cut edges of compressed parts of sheet metal, in particular a structural or chassis component made of high strength steel or light metal for use in motor vehicles, oftentimes constitute weak points when subjected to high stress, in particular when exposed to a dynamic load or in the event of a crash. Under those circumstances, cracks develop in the area of the cut edges as a result of high stress to which these edge zones are exposed during operation. When the edge zones are mechanically cut, the texture changes and microcracks develop which render the structural or chassis components more susceptible to develop cracks. At the same time, the thickness of the structural or chassis components along the cut edge is reduced as a result of the necessary cutting pressure. Using thermal cutting processes cannot overcome these problems because the edge area is generally weakened by process-related notches along the cut edge. When high strength steel is involved, its ultimate strength is weakened by the heat impact. As a consequence, finished structural or chassis components not only are prone to fail but encounter already during the manufacturing process cracks or contractions in the outer regions as a result of loads caused by flaring, trimming, beveling, or the like processes for example.

An attempt to eliminate tensile stress and microcracks along the length edges of torsion members of twist-beam axles is described in German Pat. No. DE 196 42 995 C1. The length edges are hereby upset to generate residual compressive stress. As a result, the surfaces of the cut edges are smoothed and microcracks are cold-welded.

German Offenlegungsschrift DE 33 43 709 A1 discloses a method of making a frame part for motor vehicles. The frame part is hereby formed from a blank in a press tool, with the blank being partially rolled to provide length sections of different thickness. The method involves formation of longitudinal grooves in the blank at a slight distance to the length edges and subsequently upsetting of the length edges.

For a number of reasons, the various proposals are endowed with drawbacks and shortcomings relating for example to manufacturing techniques or to the effect that is hoped to be obtained but may not always be realized.

It would therefore be desirable and advantageous to provide an improved method of making a structural or chassis component to obviate prior art shortcomings and to provide enhanced edge properties so as to produce a structural or chassis component that is reliable in operation even when exposed to high stress.

SUMMARY OF THE INVENTION

According to one aspect of the present invention, a method of making a structural or chassis component for a motor vehicle includes the steps of providing a blank with at least one material supply, placing the blank in a press tool such that an outer region of the blank confronts a buttress of the press tool, and operating the press tool to press the outer region against the buttress and to shape the material supply into the outer region and a recess of the press tool to produce a structural or chassis component.

The present invention resolves prior art problems by displacing the material supply of the blank during the shaping process into other areas of the structural or chassis component, with at least one outer region of the blank being pressed against the buttress of the press tool to thereby shape the material supply in the recess of the press tool. As a result, a precisely and accurately defined length edge is realized in the outer region of the structural or chassis component, and the quality of the edge is assured as microcracks are work-hardened or hot upset. A structural or chassis component according to the invention is much less prone to crack in the outer region, and overall its service life is significantly prolonged.

According to another feature of the present invention, the outer region may be shaped by the press tool to form a bead. A finished structural or chassis component may have one or more beads. Suitably, the bead or beads are formed in crack-prone or narrowly tolerated zones of the structural or chassis component.

The blank used for making a structural or chassis component may have a certain overmeasure in relation to a structural or chassis component in developed configuration so as to provide the blank with a material reserve for producing one or more beads in the area of the outer region.

The need for subsequent trimming operations of the outer contour of the structural or chassis component, oftentimes required by the prior art as a result of the fluctuations in the outer contour can now be omitted. The targeted placement of the material supply and the subsequent displacement of material into the area of the outer edge with defined configuration of the outer regions eliminate the need for subsequent trimming operations. The method according to the present invention is especially applicable for hot-formed press-hardened structural or chassis components.

According to another feature of the present invention, the material supply may be configured in the form of an embossment to have an undulated configuration along the outer region at a distance to the outer edge, and can then be flattened to displace material in a direction of the outer edge so as to form the bead. The embossment serves hereby as material reservoir. Suitably, the material supply may be formed in a follow-on tool simultaneously with a cutting of the blank without a separate operating cycle.

According to another feature of the present invention, the bead in the outer region may be bent in one direction transversely to a longitudinal extension of the outer region. The material supply is suitably displaced in the zones of the structural or chassis component in which a bead formation cannot interfere with a further processing of the structural or chassis component. Of course, the outer region may also be formed with recesses or may be perforated. The blank and the structural or chassis component may be provided, for example, with holes or similar openings which are then finish-formed during the shaping operation in the press tool with tolerance. The outer region may hereby be provided with openings as well as a bead.

According to another feature of the present invention, the outer region may be formed via the buttress with tolerance. As a result, a deep-drawn outer region is produced within permissible tolerances and there is no longer any need for a trimming operation. This, too, prevents microcracks.

According to another feature of the present invention, the structural or chassis component may be hot-formed or cold-formed. When hot forming is involved, the structural or chassis component may be hardened at least partially in the press tool.

According to another aspect of the present invention, a structural or chassis component includes a cup-shaped body having a cross section of U shape or V shape to define a web, two legs connected to the web, and two flanges respectively connected to the ends of the legs, each of the flanges having a free end formed with a bead which juts out from the flange in a direction of the web, and a cover plate joined to the flanges of the cup-shaped body for closing the cup-shaped body. Suitably, the cover plate is joined to the flanges at their flat side opposite to the bead so that flat contact surfaces of the flanges and the cover plate can be placed upon one another and joined together. The beads are thus prevented from interfering with the joining operation, e.g. spot welding.

A structural or chassis component according to the present invention can be exposed to high static and dynamic stress and is much less prone to develop cracks.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
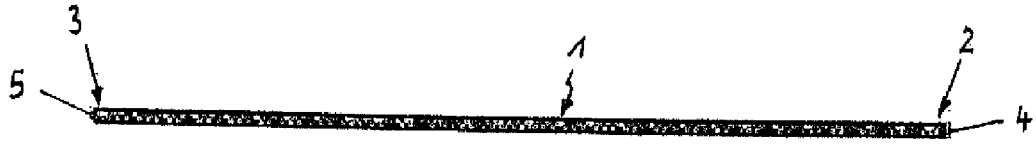
FIG. 1 is a cross section of a blank for making a structural or chassis component according to the present invention.

Throughout all the Figures, same or corresponding elements are generally indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 2:
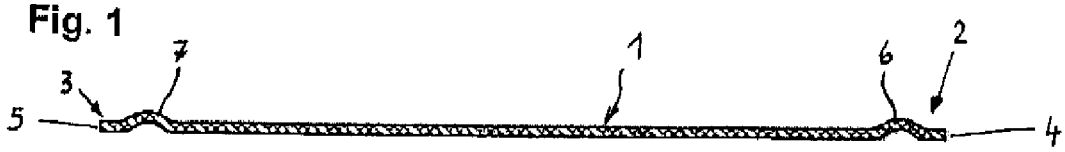
FIG. 2 is a cross section of the blank with materials supplies respectively formed on both outer regions.

Turning now to the drawing, and in particular to FIG. 1, there is shown a cross section of a blank, generally designated by reference number 1, for making a structural or chassis component for motor vehicles. The blank 1 is made of steel or light metal and is cut to size from a coil. Optionally, the blank 1 may be pre-fabricated by means of a cutting operation. The blank 1 is initially formed along both outer regions 2, 3 at a slight distance to the corresponding outer edges 4, 5 with an undulating material supply 6, 7 in the form of an embossment, as shown in FIG. 2. Of course, the provision of one outer region with a material supply may be sufficient for some applications. The material supplies 6, 7 can be made while the blank 1 is cut in a follow-on tool. Subsequently, the blank 1 with the material supplies 6, 7 is shaped in a press tool 8 into a structural or chassis component, as will be described with reference to FIGS. 3*a*-3*c* hereinafter. The press tool 8 involved here may be a cold forming tool or a hot forming tool and includes an upper die 10 and a lower die 11 between which a cavity 12 is formed during the shaping operation.

Figure 3:
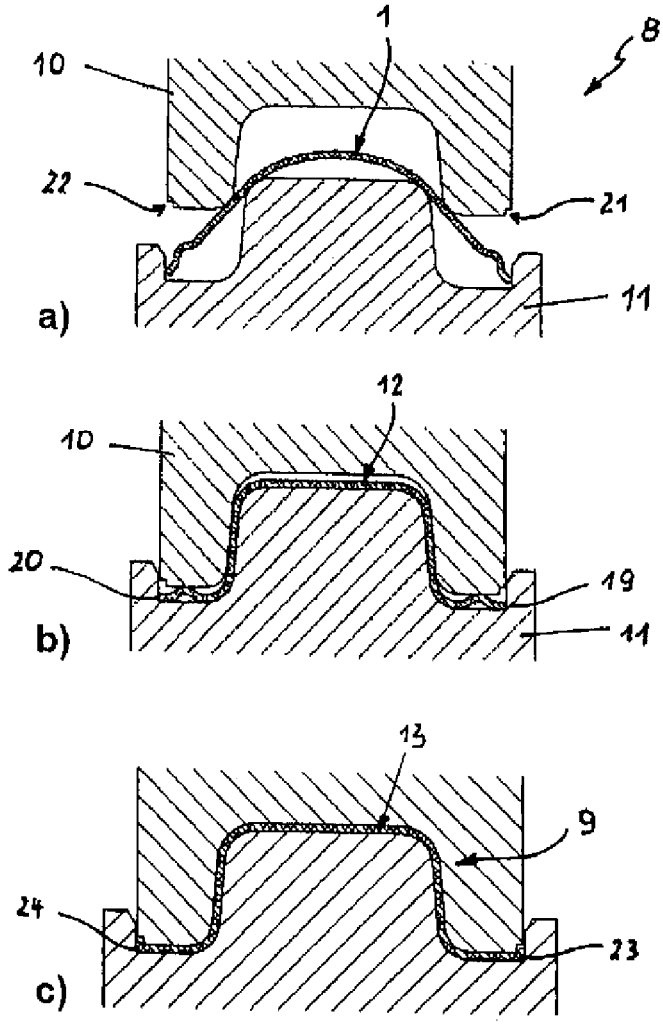
FIGS. 3*a*-3*c* are sectional views of a press tool, showing the shaping process of the blank in three stages.

The blank 1 is placed into the press tool 8 and the upper and lower dies 10, 11 are moved relative to one another, as shown in FIG. 3*a*. As the upper and lower dies 10, 11 of the press tool 8 further approach one another, a cup-shaped body 13 of U-shaped cross section is formed, as shown in FIG. 3*b*. The cup-shaped body 13 has a web 14, two legs 15, 16, and outwardly directed flanges 17, 18 respectively connected to the ends of the legs 15, 16. In the end position of the press tool 8, as shown in FIG. 3*c*, the material supplies 6, 7 are flattened so that material is displaced in the direction to the outer edges 4, 5. The outer regions 2, 3 of the blank 1 are hereby pressed against respective buttresses 19, 20 in the lower die 11 of the press tool 8 and shaped in respective recesses 21, 22 in the upper die 10 of the press tool 8 to thereby form beads 23, 24, respectively, in the outer regions 2, 3.

As shown in FIG. 3*c*, the beads 23, 24 are bent transversely to the length extension of the outer regions 2, 3 in a direction toward the web 14 so that the beads 23, 24 jut out from the flanges 17, 18 toward the web 14.

The beads 23, 24 impart the fabricated structural or chassis component with defined length edge zones along the outer regions 2, 3 which show little tendency for crack development and are very accurate to size. No further cutting operations along the outer regions 2, 3 of the structural or chassis component are necessary.

Figure 4:
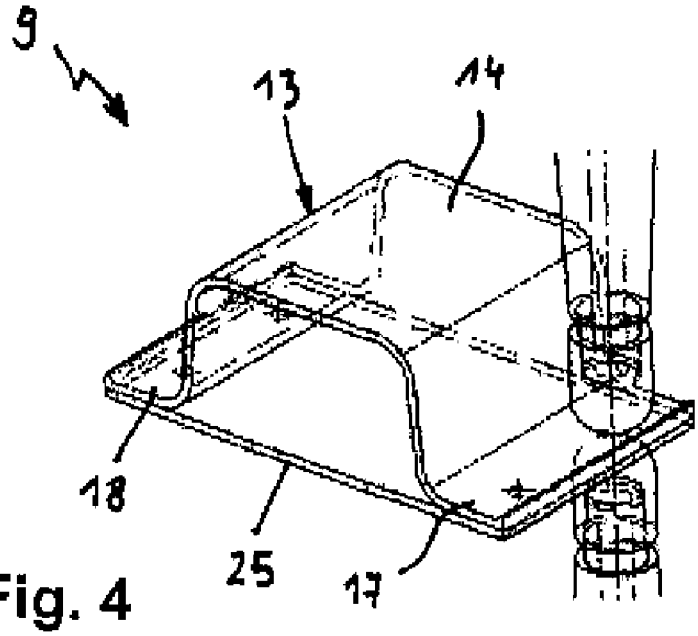
FIG. 4 is a top and side perspective view of a portion of a structural or chassis component according to the invention.
Figure 5:
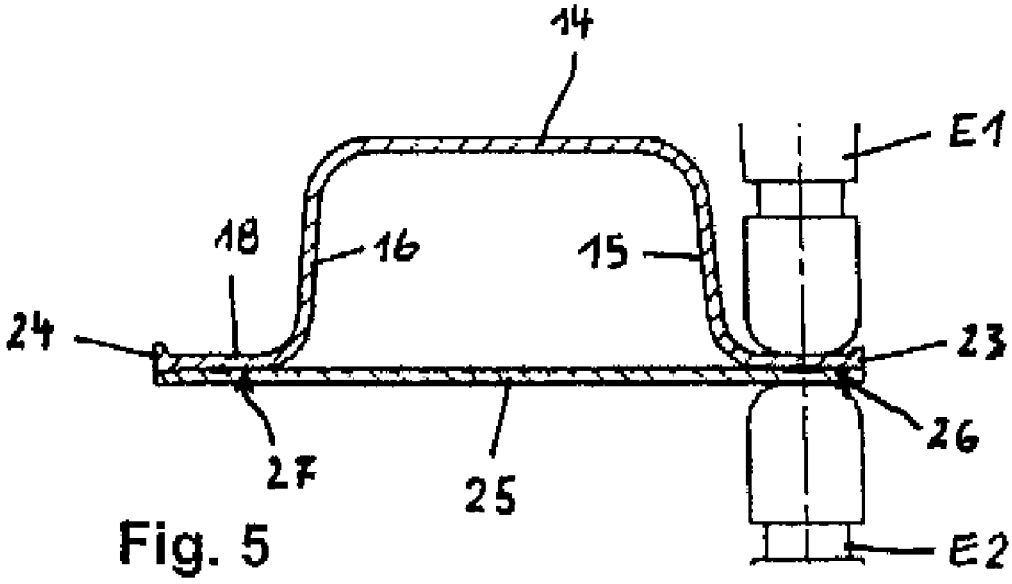
FIG. 5 is a sectional view from the front of the structural or chassis component of FIG. 4

FIGS. 4 and 5 show a section of the cup-shaped body 13 of a structural or chassis component according to the present invention 9. The cup-shaped body 12 is closed by a cover plate 25 which is joined to the flat bead-distal side 26, 27 of the flanges 17, 18 of the cup-shaped body 13. Reference signs E1, E2 designate welding electrodes by which the cup-shaped body 13 and the cover plate 25 can be spot welded. As the beads 23, 24 are bent in a direction of the web 14 of the cup-shaped body 13, they cannot interfere with the spot welding operation.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A method of making a structural or chassis component for a motor vehicle, comprising the steps of:

providing a blank with at least one material supply;

placing the blank in a press tool such that at least one outer region of the blank confronts a buttress of the press tool; and operating the press tool to press the outer region against the buttress and to force the material supply into the outer region and outwards into a recess of the press tool to produce a structural or chassis component, wherein the outer region is shaped by the press tool to form a bead, wherein the providing step involves the step of shaping the material supply with an undulated configuration along the outer region at a distance to an outer edge, said operating step including the step of flattening the material supply to displace material in a direction of the outer edge to form the bead.

2. The method of claim 1, wherein the bead of the outer region is bent in one direction.

3. The method of claim 1, further comprising the step of hot forming the structural or chassis component in the press tool, and hardening the structural or chassis component at least partially.

4. The method of claim 1, further comprising the step of cold forming the structural or chassis component.

5. The method of claim 1, further comprising the step of finish-forming the blank with formation of holes with tolerance.

6. The method of claim 1, wherein the operating step includes the step of displacing the material supply for formation of a bead in a region which does not interfere with a further processing of the structural or chassis component.

7. The method of claim 1, wherein the outer region is formed via the buttress with tolerance.

8. The method of claim 1, wherein the providing step includes the step of forming the blank with an embossment to form the material supply.

9. The method of claim 1, wherein the blank is made of steel.

10. The method of claim 1, wherein the blank is made of a light metal.

11. The method of claim 1, wherein the material supply has an undulating configuration, the operating step including the step of bending the blank into a U-shaped configuration while maintaining the undulating configuration of the material supply.

* * * * *